US006247980B1

(12) United States Patent
Moore et al.

(10) Patent No.: US 6,247,980 B1
(45) Date of Patent: Jun. 19, 2001

(54) SELF CLEANING TROLLING MOTOR

(75) Inventors: Prentice G. Moore; William A. Henderson, both of Starkville; David W. Welch, Columbus, all of MS (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/560,481

(22) Filed: Apr. 28, 2000

(51) Int. Cl.[7] ..... B63H 1/28
(52) U.S. Cl. ..... 440/73; 440/6
(58) Field of Search ..... 440/73, 6, 7, 1

(56) References Cited

U.S. PATENT DOCUMENTS 4,099,478 7/1978 Alexander, Jr. .
4,902,255 2/1990 Faunda .

*Primary Examiner*—Sherman Basinger
(74) *Attorney, Agent, or Firm*—Fellers, Snider, Blankenship, Bailey & Tippens, P.C.

(57) ABSTRACT

This invention relates to a trolling motor which includes a control system capable of executing a predetermined sequence of events which will clear entangled weeds from the propeller, motor housing, and support column. The control system for the trolling motor provides momentary reversal of the propeller to accomplish reliable cleaning of the submerged components of the trolling motor without disturbing the operator selected forward speed. The system includes an input for manually activating a cleaning cycle, for periodically activating cleaning cycles, or for automatically activating a cleaning cycle upon detection of weed fouling of the submerged components.

21 Claims, 8 Drawing Sheets

SELF CLEANING TROLLING MOTOR

BACKGROUND OF THE INVENTION

1. Field of the Invention

This invention relates generally to a trolling motor which includes a propeller, motor housing, and support column cleaning function. More specifically, it relates to a trolling motor which includes a motor control system which is capable of executing a predetermined sequence of events which will loosen or clear entangled weeds from the propeller, motor housing, and support column.

2. Background

Trolling motors are waterproof electric motors, typically under two horsepower which are fitted with a propeller and used to control the movement and position of fishing boats. Operation of trolling motors in weed infested waters has long been recognized as a problem. Weeds become entangled on the support column, the motor housing and the propeller, thereby causing a dramatic reduction in performance, even to the point where propulsion of the boat becomes impossible. Typically when weed fouling occurs, the user first attempts to remove the weeds by manipulating the controls of the trolling motor. This might involve increasing the speed to full speed and steering the trolling motor in a different direction. When this method fails, the user must pull the trolling motor out of the water and remove the weeds by hand. This, however, is not a satisfactory situation since during the time the trolling motor is out of the water, the boat is free to drift, often times moving further into weed infested areas and making the situation worse. Furthermore, if the trolling motor is not equipped with an automatic shut-off which operates to disable the motor when it is out of the water, hand cleaning could present a potential safety problem. Over time, numerous techniques have been developed to deal with weed entanglement but none of these techniques has proven satisfactory for all operating environments.

For example, devices have been developed which attach to the motor housing and support column which are intended to deflect weeds away from the propeller. Unfortunately, these devices create drag which hampers the effectiveness of the trolling motor even when not in weed infested areas, they provide no protection for the support column or motor housing, and they do not completely eliminate entanglement of the propeller. In fact, these devices themselves can collect weeds, thereby adding additional drag and making the trolling motor difficult, or impossible, to steer.

A second approach has been to utilize specially designed propellers, commonly called weedless propellers. These propellers are shaped such that they reduce weed gathering and shed, rather than collect, weeds. However, the performance of these propellers, in regards to their ability to self clean, changes with propeller speed. Fouling of the propeller, support column, and motor housing is much more likely to occur at low speed operation than at high speed. Additionally, these propellers do not reduce weed fouling of the support column and motor housing, which causes further drag and reduces the effectiveness of the trolling motor.

It has been recognized that momentarily reversing the direction of rotation of the motor can cause entangled weeds to disengage from the propeller. However, most trolling motors which utilize a foot pedal control do not provide any means for reversing the motor. Even with trolling motors which have a means for reversing rotation, the user must manually activate reversal of the motor, thereby disturbing the present speed setting, and thereafter must manually reset the motor to the previous forward speed.

It is thus an object of the present invention to provide a reliable means for cleaning weeds from the propeller, support column, and motor housing of a trolling motor without adversely affecting the operation of the trolling motor.

It is a further object of this invention to provide the trolling motor operator with a means for manually activating a cleaning cycle or periodically activating cleaning cycles without disturbing the preselected forward speed setting of the trolling motor.

It is still a further object of this invention to provide detection of weed fouling of submerged elements of the trolling motor and to automatically activate a cleaning cycle when appropriate.

SUMMARY OF THE INVENTION

These and other objects are achieved in a trolling motor incorporating a motor and electronic control system such that the combination provides a means for momentarily reversing the direction of rotation of the propeller, either automatically or manually, without disturbing the speed set by the operator. The preferred electronic control system includes an input for receiving an user adjustable motor speed and at least one output capable of motivating the propeller to selectively spin in either direction.

In accordance with one aspect of the invention, there is disclosed a trolling motor control system including an input whereby the operator can manually cause the trolling motor to momentarily reverse the direction of rotation of its propeller at a particular speed and thereafter to return to the user selected speed.

In accordance with another aspect of the invention, there is disclosed a control system including at least one timer which produces a periodic signal to automatically activate a cleaning cycle whereupon the propeller is induced to momentarily reverse its direction of rotation at a particular speed for a particular period of time and to thereafter return to the user selected speed.

In accordance with another aspect of the present invention, there is provided a system for automatically sensing when the propeller has become fouled and thereafter initiating a cleaning cycle. In the preferred embodiment, a comparator receives a signal representative of motor performance and, if the performance differs significantly from a threshold level, the comparator initiates a cleaning cycle, wherein the motor is directed to reverse momentarily and thereafter directed to rotate again in the original direction. It is critical for purposes of the instant embodiment that when the motor is directed to rotate again in the original direction it additionally be instructed to return to approximately the same velocity that had been specified by the operator prior to the detection of a fouling condition.

In one preferred automatic cleaning embodiment, the signal representative of motor performance is a tachometer signal which might be provided by a separate tachometer or, alternatively, a tachometer means integral to the control system. In either case, the control system will be able to sense the rotational speed of the propeller, which speed is indicative of weed fouling.

In another preferred automatic cleaning embodiment, the motor performance signal is provided by an electrical current sensing circuit which monitors the current drawn by the motor. When the current exceeds some threshold value for a given selected propeller speed, fouling is indicated.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the construction illustrated and the steps described herein. The invention is capable of other embodiments and of being practiced or carried out in a variety of ways. It should be understood the phraseology and terminology employed herein is for the purpose of description and not of limitation.

Figure 1:
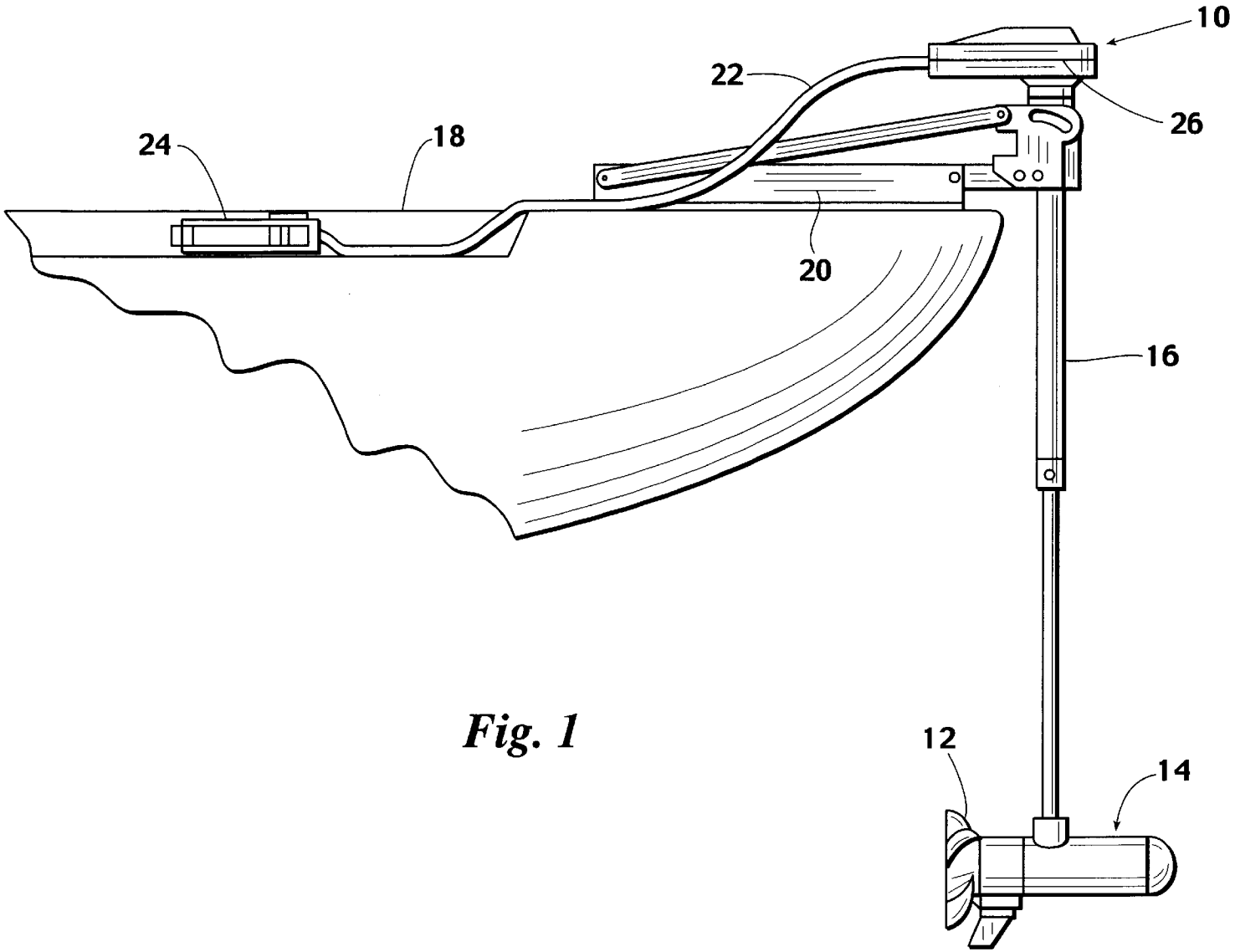
FIG. 1 provides an illustration of the general environment of the instant invention.

Referring initially to FIG. 1, there is shown the general environment of the instant invention including a typical trolling motor, generally indicated by reference numeral 10. Preferably, the trolling motor includes a propeller 12 which is rotatably driven by a submerged motor 14 which is preferably electrically driven. A support column 16 extends downward from the deck of a fishing boat 18 to support the electric motor 14 and the propeller 12. A mounting bracket 20 attaches the trolling motor 10 to the boat 18. In a typical arrangement, an electrical or mechanical control cable 22 connects a foot pedal 24 to a control head 26. The foot pedal 24 controls the rotational speed of the propeller and facilitates hands-free steering of the boat. The control head 26 houses a motor controller 30 (FIG. 2) which provides suitable circuitry to drive the electric motor 14, thereby urging rotation of the propeller 12.

Figure 2:
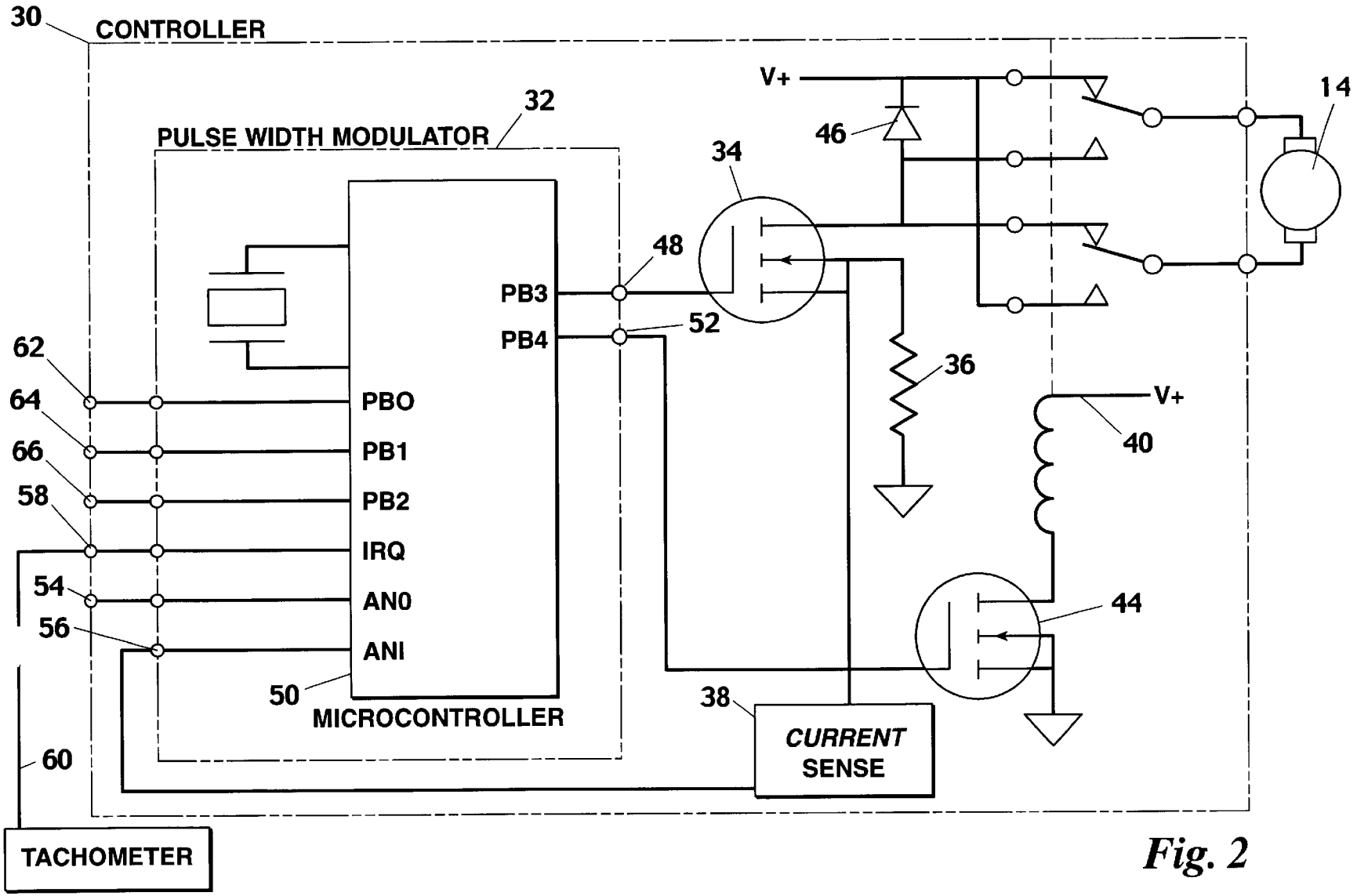
FIG. 2 provides a block diagram of a preferred control system for a self-cleaning trolling motor.

Referring now to FIG. 2, there is shown a block diagram for a preferred embodiment 30 of the present invention which would be suitable for use with a trolling motor with an electric motor 14. Broadly speaking, a function of the inventive controller 30 is to implement a cleaning cycle whenever either motor conditions or user input suggests that such a cycle is necessary. Note that, as used herein, the phrase "cleaning cycle" will be taken to mean a momentary reversal of the rotational direction of the propeller followed by a return to rotation in the original direction at a speed substantially equal to the speed of the propeller before reversal. Furthermore, in the text that follows the phrase "desired speed" will be used in the broadest sense to mean some measure of either the actual pre-reversal propeller speed or the speed as selected by the operator, whether or not actually attained. That is the fisherman/operator may have set the propeller to rotate at a particular speed (e.g. via the foot pedal 24) but propeller fouling may have prevented the motor from reaching that speed. So after propeller reversal, the instant controller 30 will direct the motor to return to a speed that imports some sense of continuity of forward velocity to the fisherman.

Motor controller 30 preferably comprises a pulse width modulator 32, a power transistor 34, a current sensing resistor 36, a current sense 38, a direction relay 40, a direction relay driver 44, and a freewheeling diode 46.

The power transistor 34 switches the motor 14 on and off in accordance with the pulse width modulator output 48. Variability of the motor speed is achieved by switching the transistor 34 off and on with a rectangular wave, preferably at a frequency above the audible range (e.g., 22 kilohertz). The pulse width modulator 32 varies the ratio of high time to total time of the rectangular wave resulting in a variable duty cycle wave. The power transistor 34 switches the motor 14 on and off in direct correlation with the pulse width modulator output 48, thereby varying the effective voltage driving the motor 14. The freewheeling diode 46 is used to clamp the inductive kick produced by the motor 14 during switching transients, thereby protecting the power transistor 34 from transient voltage potentials which might exceed its maximum rating.

The current sensing resistor 36 works in concert with the current sense 38 to generate a signal which is representative of the current flowing through the motor 14. Since electrical current only flows through the current sensing resistor 36 during the high portion of the rectangular wave from the pulse width modulator 32, the current sense 38 responds to the voltage produced across the current sensing resistor 36 during this interval to generate a signal which is readily usable by the pulse width modulator 32.

The direction relay 40, which is energized by the direction relay driver 44 in response to an output 52 of the pulse width modulator 32, is used to reverse the direction of the current flowing through the motor 14 and thereby reverse the direction of rotation of the motor 14.

As is further shown in FIG. 2, the preferred embodiment of the pulse width modulator 32 uses a microcontroller 50. Such devices are available from a variety of manufacturers and are well known in the art. Several of these devices include an internal timer which may be configured to produce a variable duty cycle signal directly on an output pin of the device. These devices are particularly well suited for use in the inventive pulse width modulator, however, many other microcontrollers or microprocessors are capable of performing the functions described herein. It will be obvious to those skilled in the art that there are numerous alternative embodiments for the pulse width modulator. For example, integrated circuits are available which provide an integrated pulse width modulator as well as other related functions. One such integrated circuit is part number SG3524 available from Philips Semiconductor.

The microcontroller 50 includes a first analog input 54 which receives a signal representative of the desired trolling motor speed. A second analog input 56 receives the output of the current sense 38 which is representative of the electrical current passing through the motor 14. A first digital input 58, capable of producing an interrupt in the microcontroller 50, receives a tachometer signal 60 from the trolling motor representing the rotational speed of the propeller 12. A second digital input 62 receives a signal used to initiate a manual cleaning cycle A third digital input 64 and a fourth digital input 66 receive a code directing the operating mode of the pulse width modulator 32.

Preferably, the tachometer signal 60 is a series of pulses, the frequency of which is proportional to the rotational speed of the propeller 12. Other tachometer means such as a tachometer which produces a voltage proportional to the rotational speed of the tachometer are well known in the art and would be suitable for the present invention. Additionally, it will be apparent to those skilled in the art that with appropriate circuitry, the microcontroller 50 could sample the back EMF from the motor 14 during the low time of the pulse width modulated output 48 to determine the rotational speed of the motor 14.

It will be apparent to those skilled in the art that alternatively, the various input signals detailed above could be communicated to the pulse width modulator 32 by a variety of means, such as a single channel of asynchronous serial data, or a proprietary communication scheme.

The preceding text has described one preferred hardware embodiment, but those skilled in the art will recognize that many variations in the specific hardware combination are possible and, in fact, have been contemplated by the instant inventors. For example a conventional H-bridge driver could be used in place of the direction relay 40, the direction relay driver 44, and the power transistor 34, or the pulse width modulator 32 could be implemented using conventional analog and digital components.

Figure 4:
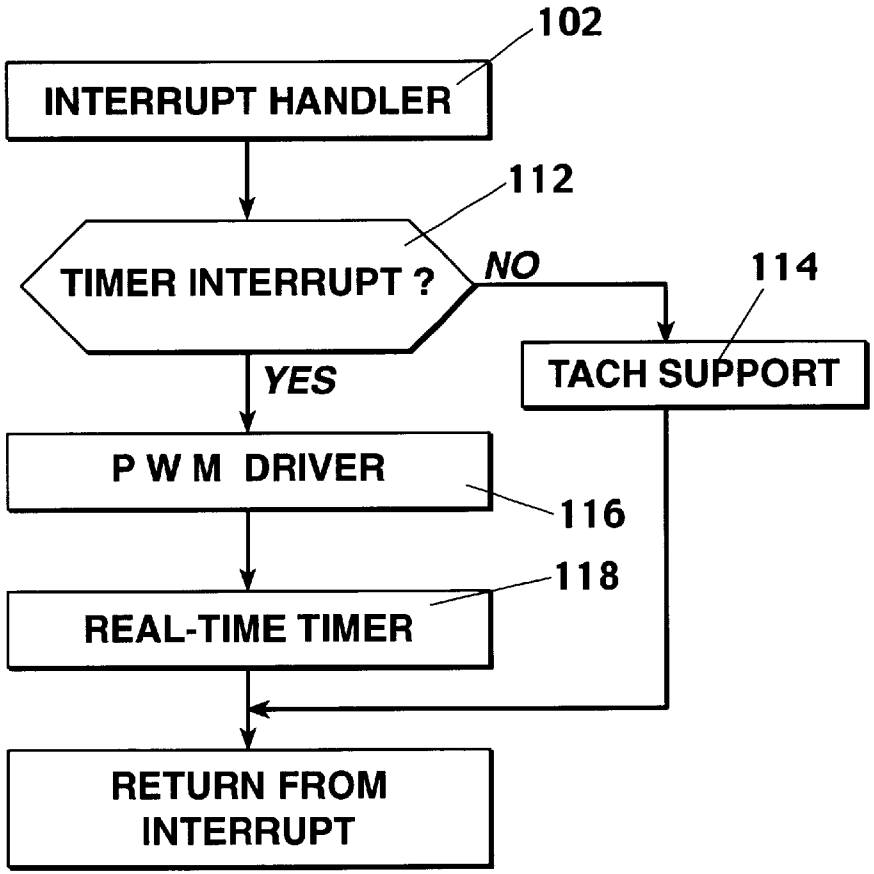
FIG. 4 provides a high level flow diagram for a software program to provide interrupt service in support of a cleaning function.
Figure 3:
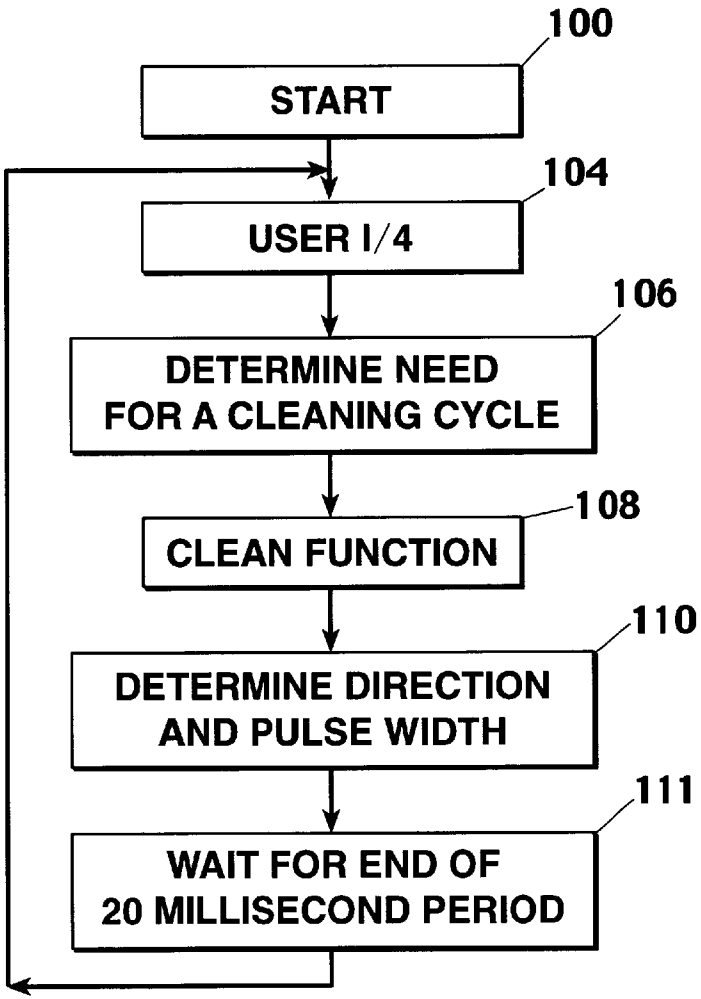
FIG. 3 contains a flow diagram for implementing a preferred cleaning function.

The microcontroller 50, is preferably programmed to execute a series of instructions represented by the flow diagrams of FIGS. 3–12. In the preferred embodiment, the tasks are divided into a foreground loop 100 (FIG. 3) and background tasks 102 (FIG. 4).

Preferably, the foreground loop 100 provides support for the user interface 104, monitors conditions which indicate a need for a cleaning cycle 106, performs cleaning cycles as needed 108, determines the desired direction of rotation, calculates pulse width parameters 110, and aligns execution of the foreground loop with a background timer 111 to provide reasonably accurate timing of foreground functions.

Figure 5:
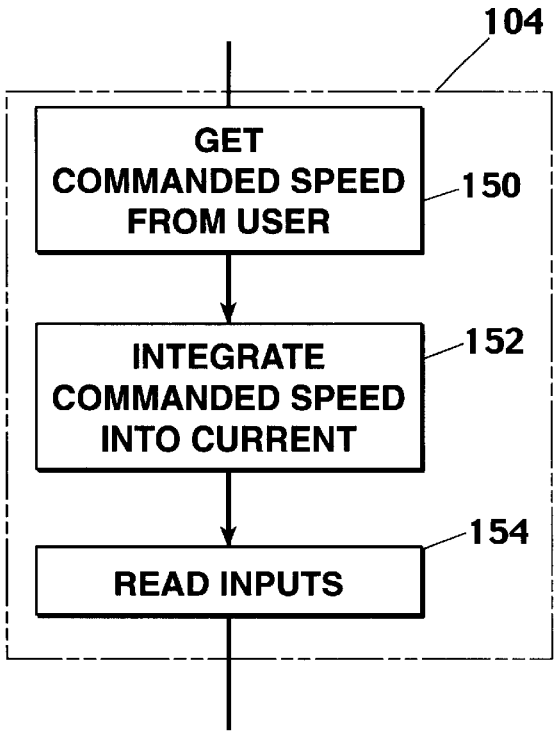
FIG. 5 provides a detailed flow diagram for a software program to implement the user interface.

Referring to FIG. 5, a flow diagram is shown for the preferred embodiment of the user interface 104 software code. First, the user selected speed is determined by converting the analog input for commanded speed into its binary representation 150 where the commanded speed will preferably come from a user-controlled device such as a foot pedal 24. If it is desired, the commanded speed could be low-pass filtered by means of a simple integration 152 to avoid instantaneous changes in speed thereby reducing the peak current drawn by the electric motor 14. Next, the digital input indicative of a user request for a manual cleaning cycle and the digital inputs specifying the operational mode are read, thereby completing the user interface section of the operating software.

Figure 6:
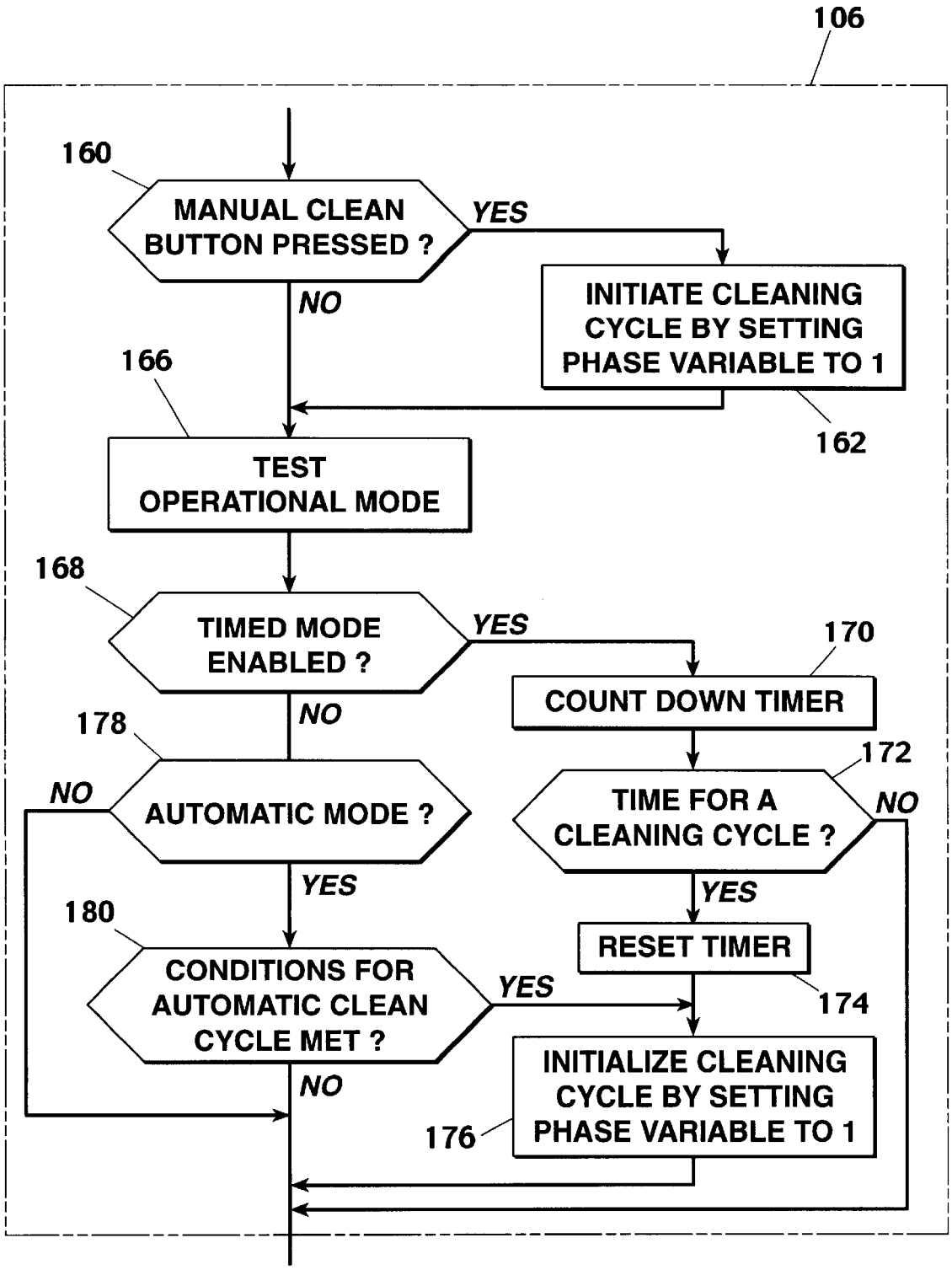
FIG. 6 provides a detailed flow diagram for a software program to determine the need for a cleaning cycle.

Referring to FIG. 6, a flow diagram for determining the need for a cleaning cycle 106 is shown. In one embodiment of the invention, the operator can manually cause the trolling motor control system to perform a cleaning cycle. Preferably, the initiating signal from a user 160 is indicated by the digital input 62 (FIG. 2). Upon receipt of the initiating signal, a cleaning cycle is initiated 162.

As a next preferred step, the operating mode is tested 166. Preferably, three distinct operational modes are decoded from the two digital inputs 64 and 66. In a first operational mode 168 the motor control system will perform a cleaning cycle at regular predetermined intervals. In a second operational mode 178, the motor control system will sense a condition indicative of weed fouling and automatically initiate a cleaning cycle in response to such a condition. In the third operational mode, no cleaning cycles will occur unless manually initiated by the operator.

Preferably, if the user has selected a timed mode 168, a counter is decremented each pass of the foreground loop 100 until the counter reaches zero 170. When the counter reaches zero 172, a cleaning cycle is initiated 176 and the counter is reset to a particular value 174, which might either be preset at the factory, adaptively set by the controller (e.g., by examining the recent cleaning history), or set by the user.

Alternatively, if the user has selected the automatic mode 178, then conditions precedent to executing an automatic cleaning cycle are tested 180. Upon detecting the conditions precedent, a cleaning cycle is initiated 176.

Figure 7:
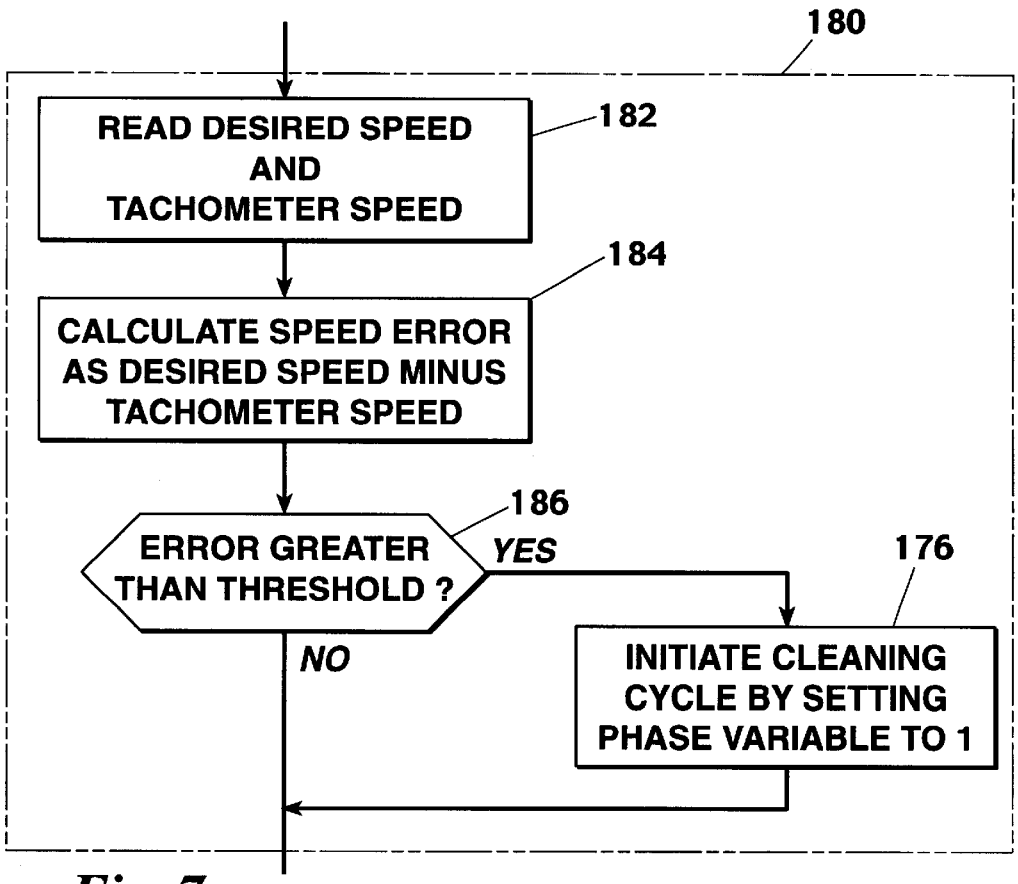
FIG. 7 provides a detailed flow diagram for a preferred method for automatic detection of weed fouling of the trolling motor.

Referring now to FIG. 7, in one embodiment of the invention, a cleaning cycle will be initiated if the user selected speed deviates too far form the actual speed as reported by a tachometer. First, the desired speed and tachometer speed are read from memory 182. A comparator suitable for use with the present invention, produces a logical output by subtracting the actual speed, as reported by the tachometer, from the desired speed 184. If this difference exceeds a particular threshold value 186, the comparator initiates a cleaning cycle 176. Obviously, the threshold value might be a fixed value which is specified at the time of manufacture or by the user, or a variable value that is dependent on the sensed speed indicated by the tachometer signal 60 (FIG. 2) or the desired speed.

Figure 8:
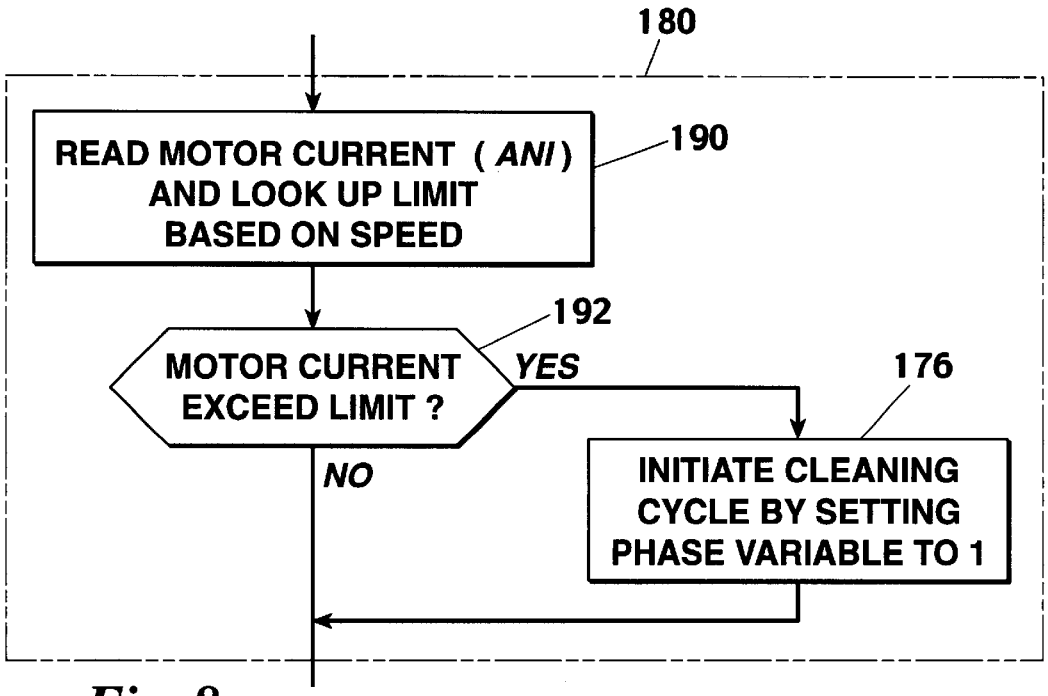
FIG. 8 provides a detailed flow diagram for a second preferred method for automatic detection of weed fouling of a trolling motor.

Referring next to FIG. 8, in another embodiment of the invention, a cleaning cycle will be initiated if the electrical current exceeds a particular threshold value, in light of the operating speed. In this configuration, a maximum electrical current is preferably either calculated or drawn from a look-up table based upon the commanded speed and the electrical current, as reported by the current sense 38, is read 190. A comparator 192 produces a logical output by comparing the maximum electrical current as previously determined against the sensed electrical current. If the sensed electrical current exceeds the maximum electrical current, the comparator initiates a cleaning cycle 176.

Figure 9:
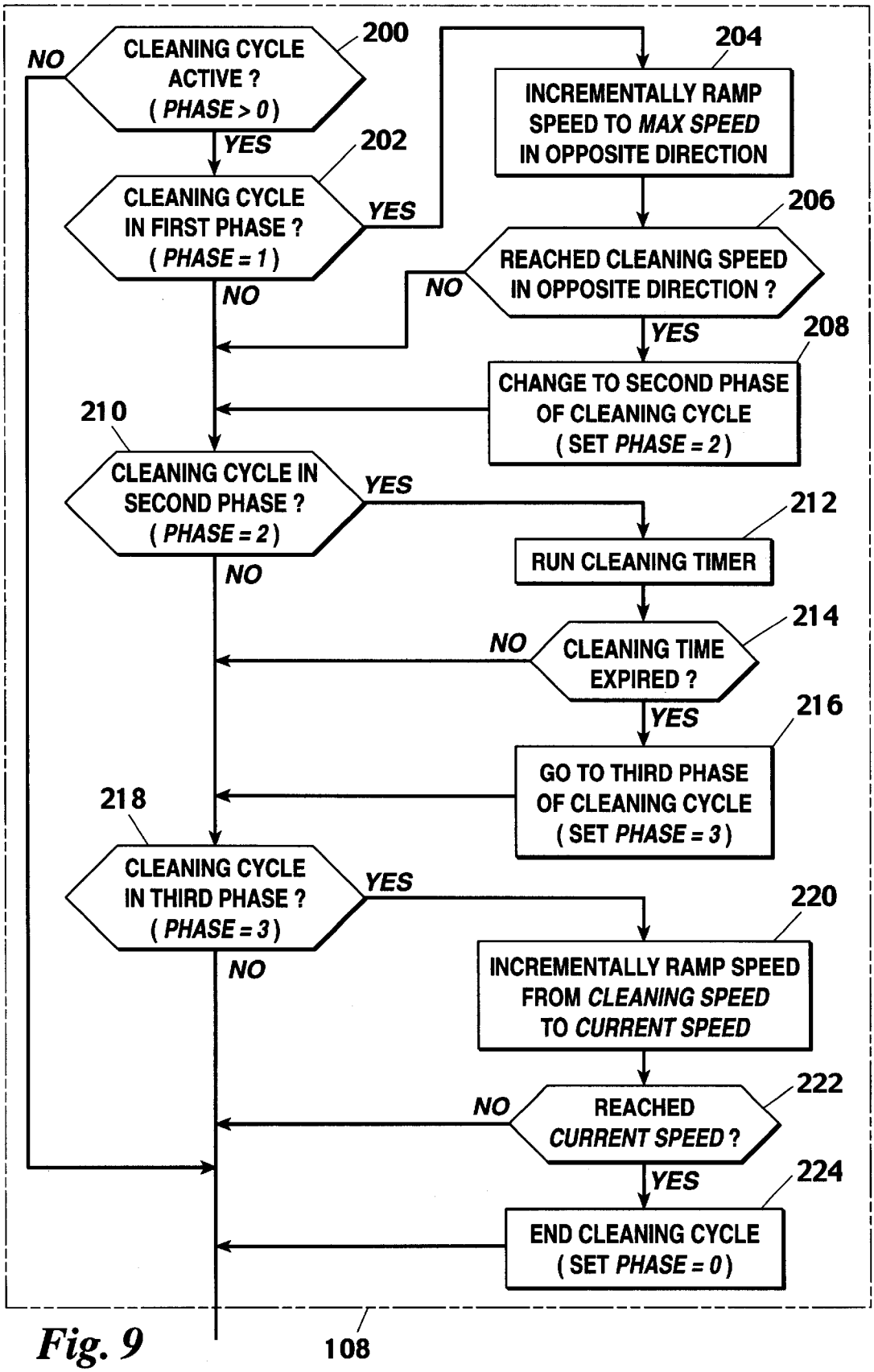
FIG. 9 provides a detailed flow diagram for a cleaning cycle.

Referring now to FIG. 9, a flow diagram is shown for the cleaning function 108. Note that, as a general matter, the instant invention operates similarly whether the motor is being operated in the forward direction or the reverse direction when a cleaning cycle is initiated. If the user commanded speed is in the forward direction the cleaning cycle will rotate the propeller in the reverse direction. Conversely, if the user commanded speed is in the reverse direction, the cleaning cycle will rotate the propeller in the forward direction.

In the preferred embodiment and as illustrated in FIG. 9, the cleaning cycle will pass through three phases: an initial propeller reversal phase; a cleaning operating phase; and a final propeller reversal phase ending in a return to normal operation. Preferably, each of these phases will be signaled internally through the use of an integer phase variable, which will be set to a value of 1, 2, or 3 respectively during each of the above identified phases. When there is no cleaning cycle in progress, the value of the phase variable will preferably be zero 200. Obviously, the particular values chosen for signaling purposes is purely arbitrary and many other alternatives are certainly possible.

During the first phase of the cleaning cycle (the "YES" branch of decision 202) the propeller speed will preferably be reversed by ramping from the commanded speed to a stopped condition, reversing the direction of rotation, and thereafter ramping to the maximum speed in the opposite direction 204. By ramping the speed 204 during the transitional portions of a cleaning cycle, instead of immediately reversing the motor, the peak electrical current flowing through the power transistor 14 is substantially reduced. When the speed reaches its maximum reversed value 206, the ramp is stopped, a timing variable is initialized and the cleaning cycle enters its second phase. This fact is indicated internally by setting the phase variable to two 208.

During the second phase of the cleaning cycle (the "YES" branch at decision 210), the motor is operated in the reversed direction, preferably at its maximum speed until a timer expires. The timer preferably takes the form of a timing variable, initialized with either a predetermined value or a user directed value, that is decremented 212 each pass through the loop until it reaches zero, thereby indicating the expiration of the cleaning time 214. Upon expiration of the time period, the third phase of the cleaning cycle is entered. This is signaled internally by setting the phase variable to three 216 thereby signaling the start of the transition back to the user commanded speed.

During the final phase of the cleaning cycle (the "YES" branch of decision 218), the rotational speed of the motor will be ramped from the cleaning speed to a stopped condition, the direction of rotation will again be reversed, back to the original direction of rotation, and thereafter the speed will be ramped to the commanded speed 220. When the rotational speed reaches the desired operating speed 222, the cleaning cycle is terminated. It is important to note that the term "commanded speed" should be interpreted broadly to mean the pre-cleaning speed selected by the user or any other speed measurement such as the actual motor speed. Termination of the cleaning cycle is signaled internally by setting the phase variable to zero 224.

Figure 10:
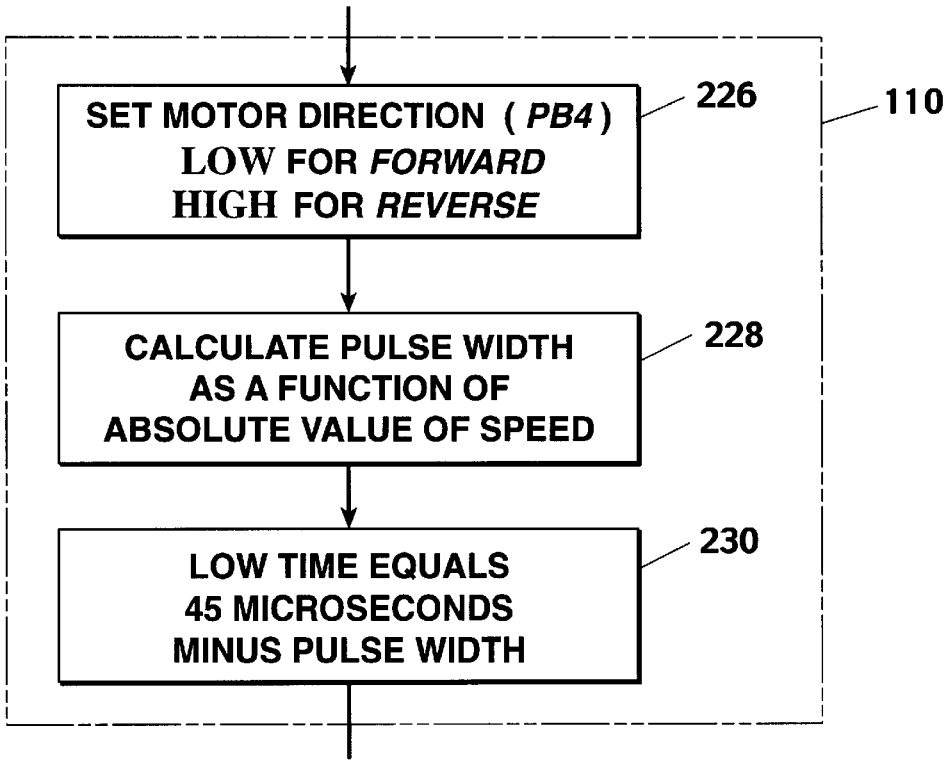
FIG. 10 provides flow diagram for determining the parameters for the pulse width modulated signal.

Turning now to FIG. 10, a flow diagram is shown which determines the appropriate direction of rotation of the motor 14 and calculates the pulse width parameters 110. If the commanded direction is forward, the output which is connected to the direction relay driver 44 is set to a logical zero, otherwise, the output is set to a logical one 226, which causes the direction relay driver 44 to conduct, thereby energizing the direction relay 40 and reversing the motor direction.

In the next step, the absolute value of the desired speed is used to calculate the high time of the pulse width modulated output 228. The low time is preferably calculated by subtracting the high time from a constant 230. This will result in a constant frequency, variable duty cycle output when processed by the pulse width modulator background task 116 (FIG. 4).

Returning now to FIG. 3, the final step in the foreground loop is to wait some period of time, preferably aligning each pass through the foreground loop with a time base 111. A background timer 118 (FIG. 4) will set a flag, on, for example approximately 20 millisecond intervals. When this flag is set, execution resumes at the top of the foreground loop 100.

Figure 11:
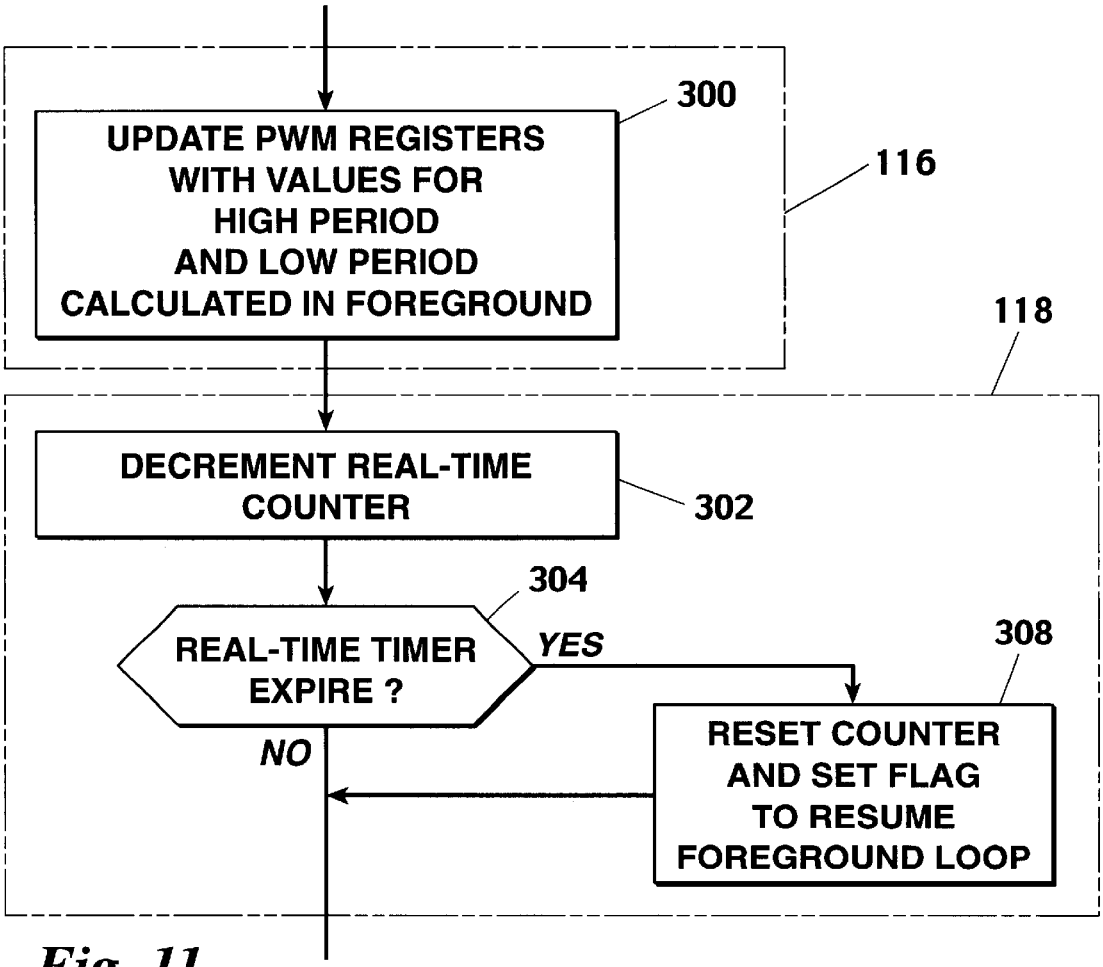
FIG. 11 provides a detailed flow diagram for a software program to provide interrupt service in support of a cleaning function.
Figure 12:
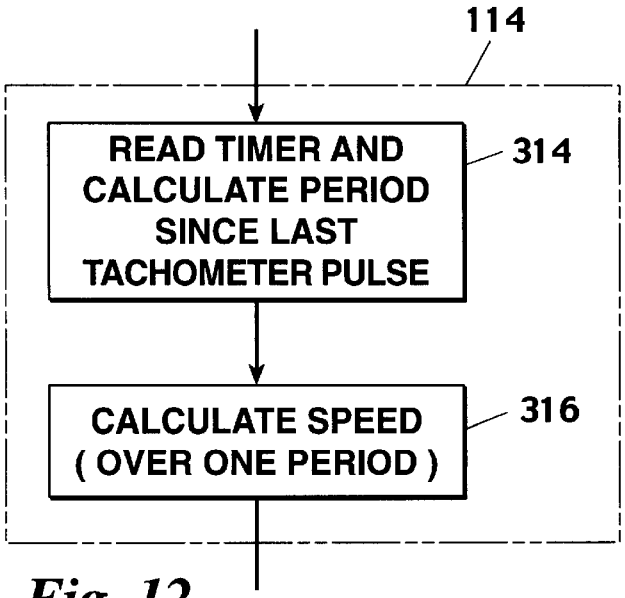
FIG. 12 provides a flow diagram for a software program to support a tachometer input.

Referring now to FIG. 4, various background tasks are controlled by the interrupt handling routine 102, which begins execution upon the receipt of an interrupt. First, the source of the interrupt must be determined and execution dispatched to the appropriate routine 112. If the source of the interrupt is the timer module the pulse width modulator driver 116 and the real-time timer 118, as shown in FIG. 11, are executed. Alternatively, if the source of the interrupt is not the timer module, in the preferred embodiment the tachometer support routine 114, as shown in FIG. 12, is executed.

If the source of the interrupt is the internal timer which supports a variable duty cycle output, the pulse width modulator driver 116 will perform the software tasks associated with maintaining the pulse width modulator output as shown in FIG. 11. Preferably, the pulse width modulator will generate an interrupt on 45 microsecond intervals, producing an approximately 22 kilohertz rectangle wave. Upon the expiration of a 45 microsecond period, the driver 116 will update the registers which set the duty cycle of the resultant wave 300. Next the real-time counter is decremented 302. Upon reaching zero 306, the real-time counter is reset and a flag is set to communicate with the foreground 308, marking the completion of a 20 millisecond period and completing the pulse width modulator driver and real-time support functions.

On the other hand, if the source of the interrupt is the tachometer signal 114, the rotational speed of the tachometer is calculated. The tachometer input 58 receives a series of pulses, the frequency of which is directly proportional to the rotational speed of the motor 14. An interrupt is generated on one edge, either rising or falling, of the tachometer signal 60. The time since the last such interrupt is determined 314 by reading the count contained in a free running timer module integral to the microcontroller 50. Rotational speed in revolutions per seconds is preferably calculated by taking the inverse of the quantity of the period between tachometer pulses times the number of tachometer pulses per revolution 316, thereby completing the tachometer support routine.

It will be readily apparent to those skilled in the art that the functions described herein could be accomplished in a variety of ways. For example a gas engine could be used in lieu of an electric motor or, in place of the microcontroller, one could use conventional analog circuitry and discrete digital logic to perform any, or all, of the controller functions described previously. As a more specific example, a differential amplifier connected to a voltage comparator could perform the function of either comparator used to initiate a cleaning cycle. These and like variations should be considered to fall within the scope of the present invention.

While the invention has been described with a certain degree of particularity, it is understood that this invention is not limited to the embodiments set forth herein for purposes of exemplification, but is to be limited only by the scope of the attached claims, including the range of equivalency to which each element thereof is entitled.

What is claimed is:

1. A self cleaning trolling motor system comprising:

(a) a trolling motor having a motor, said motor being operable to urge a propeller to rotate either in a first direction or in a second direction opposite said first direction;

(b) a controller having at least a first input and at least one output, (b1) said first input for receiving at least a signal representative of a pre-cleaning speed of the motor, and (b2) said controller being configurable to direct said motor through said at least one output to rotate said propeller in said second direction and thereafter to direct said motor through said at least one output to rotate in said first direction at substantially said pre-cleaning speed.

2. A self cleaning trolling motor system according to claim 1, wherein said signal representative of a pre-cleaning speed is a signal representative of a desired speed from a user.

3. A self cleaning trolling motor system according to claim 1, wherein said signal representative of a pre-cleaning speed is a signal representative of an actual motor speed.

4. A self cleaning trolling motor system according to claim 3, further comprising:

(c) a tachometer in communication with said motor and positionable to be in electronic communication with said first input.

5. A self cleaning trolling motor system according to claim 1, wherein said first input is additionally for receiving an initiating signal from a user.

6. A self cleaning trolling motor system according to claim 1, wherein said controller further comprises:

(c) a second input; and (d) a tachometer in communication with said motor and in communication with said second input, whereby said controller can determine a current motor speed.

7. A self cleaning trolling motor system according to claim 1, wherein said controller has a second input, said second input for receiving an initiating signal from a user.

8. A self cleaning trolling motor system according to claim 1 wherein said motor is an electric motor.

9. A self cleaning trolling motor system according to claim 8, wherein said controller has a second input for receiving a signal indicative of an electric current flowing through said motor.

10. A controller providing a self cleaning function for a trolling motor having a motor and said motor urging a reversible propeller to rotate in a first direction at a first speed, comprising:

(a) a first input and an output;

(a1) said first input for receiving a signal representative of a speed of said motor; and (a2) said controller configurable to direct said motor through said output to rotate said propeller in a second direction opposite to said first direction for a particular period of time and thereafter to direct said motor through said output to rotate said propeller in said first direction at substantially said first speed.

11. The controller providing a self cleaning function according to claim 10, further comprising:

(c) a second input, said second input for receiving an initiating signal from a user.

12. A method of cleaning a trolling motor, said trolling motor having a motor and said motor urging a reversible propeller to rotate in a first direction at a first speed, comprising the steps of:

(a) directing said motor to rotate said propeller in a second direction reverse to said first direction for a particular period of time; and thereafter (b) automatically directing said motor to rotate said propeller in said first direction at substantially said first speed.

13. A method of cleaning a trolling motor according to claim 12, wherein step (a) includes the steps of:

(a1) determining a time period since a previous motor reversal, and (a2) directing said motor to rotate said propeller in a second direction reverse to said first direction for a particular period of time if said time period since a previous motor reversal is greater than a predetermined time value.

14. A method of cleaning a trolling motor according to claim 12, wherein step (a) includes the steps of:

(a1) receiving an initiating signal from a user, and (a2) directing said motor to rotate said propeller in a second direction reverse to said first direction for a particular period of time upon receipt of said initiating signal.

15. A method of cleaning a trolling motor according to claim 12, wherein step (a) includes the steps of:

(a1) sensing a desired motor speed setting from a user, (a2) comparing said desired speed with said first speed, and (a3) directing said motor to rotate said propeller in a second direction reverse to said first direction for a particular period of time, depending upon said comparison of said desired speed and said first speed.

16. A method of cleaning a trolling motor according to claim 15, wherein step (a2) includes the step of:

(i) subtracting said first speed from said desired speed, thereby creating a speed differential.

17. A method of cleaning a trolling motor according to claim 16, wherein step (a3) includes the step of:

(i) directing said motor to rotate said propeller in a second direction opposite of said first direction for a particular period of time if said speed differential exceeds a particular value.

18. A method of cleaning a trolling motor according to claim 12, wherein step (a) includes the steps of:

(a1) sensing the electrical current flowing through said motor, (a2) comparing said electrical current with a particular value, and (a3) based on a result of said comparison of said electrical current and said particular value, directing said motor to rotate said propeller in a second direction reverse to said first direction for a particular period of time.

19. A method of cleaning a trolling motor according to claim 18, wherein step (a2) includes the steps of:

(i) calculating an index pointer using said first speed, and (ii) using said index pointer to look-up said particular value from a table.

20. A method of cleaning a trolling motor according to claim 19, wherein step (a3) includes the step of:

(i) directing said motor to rotate said propeller in a second direction opposite of said first direction for a particular period of time if said electrical current exceeds said particular value.

21. A method of cleaning a trolling motor, wherein is provided the apparatus of claim 1, comprising the steps of:

(a) sensing said signal representative of a pre-cleaning speed to determine a first speed;

(b) directing said motor to rotate said propeller in a second direction opposite of said first direction for a particular period of time; and (c) automatically directing said motor to rotate said propeller in said first direction at substantially said first speed.

* * * * *